US007059245B2

(12) United States Patent
Mayer et al.

(10) Patent No.: US 7,059,245 B2
(45) Date of Patent: Jun. 13, 2006

(54) METHOD OF CONTROLLING PRINTING PRESSES

(75) Inventors: Martin Mayer, Ladenburg (DE); Nikolaus Pfeiffer, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/406,032

(22) Filed: Apr. 3, 2003

(65) Prior Publication Data

US 2003/0213388 A1 Nov. 20, 2003

(30) Foreign Application Priority Data

Apr. 3, 2002 (DE) ..... 102 14 693.4

(51) Int. Cl.
*B41F 31/02* (2006.01)

(52) U.S. Cl. ..... 101/365; 101/403

(58) Field of Classification Search ..... 101/365, 101/483, 484, DIG. 47
See application file for complete search history.

(56) References Cited

U.S. PATENT DOCUMENTS

| | | | | |
|---|---|---|---|---|
| 3,835,777 | A * | 9/1974 | Krygeris | 101/350.4 |
| 4,200,932 | A * | 4/1980 | Schramm et al. | 101/350.1 |
| 4,524,692 | A * | 6/1985 | Rodvelt | 101/350.1 |
| 4,655,135 | A * | 4/1987 | Brovman | 101/483 |
| 4,656,941 | A * | 4/1987 | Brovman | 101/483 |
| 4,881,181 | A * | 11/1989 | Jeschke et al. | 358/1.9 |
| 5,010,820 | A * | 4/1991 | Loffler | 101/484 |
| 5,031,534 | A * | 7/1991 | Brunner | 101/365 |
| 5,031,535 | A * | 7/1991 | Kipphan et al. | 101/483 |
| 5,070,784 | A * | 12/1991 | Nishida et al. | 101/365 |
| 5,148,747 | A * | 9/1992 | Rodi et al. | 101/450.1 |
| 5,802,978 | A * | 9/1998 | Geissler et al. | 101/484 |
| 6,373,964 | B1 * | 4/2002 | Geissler et al. | 382/112 |
| 6,477,954 | B1 * | 11/2002 | Doherty | 101/365 |

FOREIGN PATENT DOCUMENTS

| | | |
|---|---|---|
| DE | 36 20 152 A1 | 1/1987 |
| DE | 39 10 330 A1 | 10/1989 |
| DE | 38 30 121 A1 | 3/1990 |
| DE | 44 39 961 A1 | 7/1995 |
| EP | 0 031 358 B1 | 7/1981 |
| EP | 0 158 945 A2 | 10/1985 |
| EP | 0 741 026 A2 | 11/1996 |
| EP | 0 741 031 A2 | 11/1996 |
| GB | 2 283 940 A | 5/1995 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

A method of controlling printing presses includes setting inking by determining setting values for at least one of pre-inking and ink metering, which encompass inking zone opening and ink stripe width, and transmitting the determined setting values to controls of the printing press. The method includes presetting the inking by setting values of earlier print jobs stored in the machine and, for optimizing the printing results, correcting for each print job and storing the corrected setting values for subsequent print jobs.

7 Claims, 2 Drawing Sheets

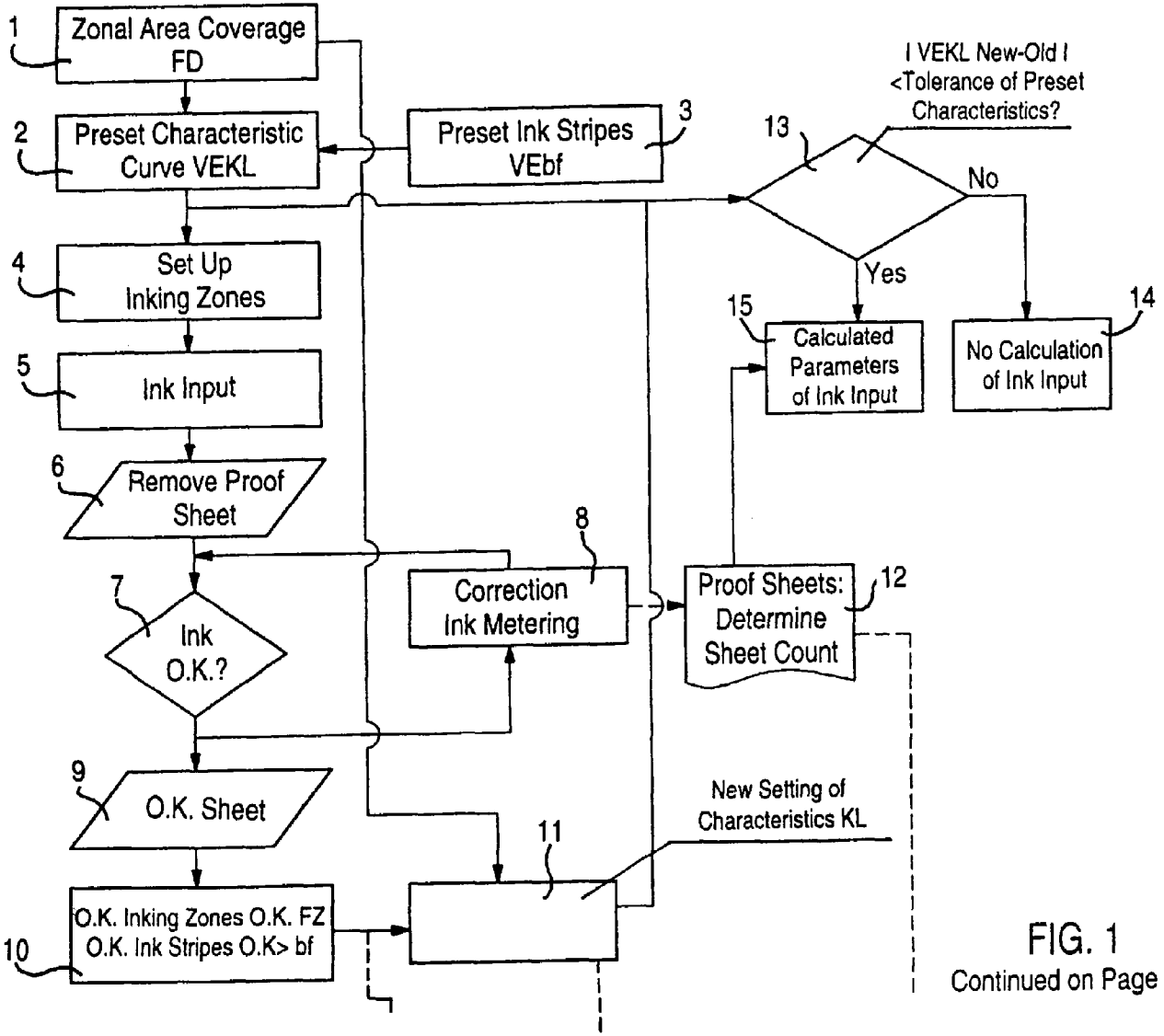
FIG. 1
Continued on Page 2/2

METHOD OF CONTROLLING PRINTING PRESSES

BACKGROUND OF THE INVENTION

Field of the Invention

The invention relates to a heuristic or adaptive method of controlling presses, in particular for correcting erroneous settings and/or optimizing inking or ink management at the start of printing a print job. The method includes determining setting values for pre-inking and/or ink metering, which encompass the inking zone opening and the ink stripe width, and transmitting the determined setting values to controls of the printing press, in order to set the inking.

Methods of correcting erroneous settings and/or of optimizing the inking or ink management at the start of printing a print job have become known heretofore in the prior art.

Since a different ink demand results over the machine width, depending upon the subject, when setting the press for a print job, the setting values for the ink metering, i.e., both the ink stripe width and the inking zone opening, have to be preset in order to ensure that an adequate ink density can be attained on the printing material. Furthermore, in order to reach the production or continuous running state rapidly, it is necessary for a prescribed quantity of ink to be introduced into the inking unit by prescribing the setting values of the pre-inking before the start of printing. With the setting of the pre-inking, the inking unit is thus prepared for the next following print job, with the quantity of ink prescribed thereby being matched to the print job.

The inking unit of the printing press is consequently set for a print job by ensuring the ink transfer from the inking unit up to the printing material to a sufficient extent, depending upon or as a function of the subject.

The ink presetting is, for example, performed before the start of printing, by a printing plate reader. In this regard, the printing plate is measured with respect to the ink demand thereof, and the data for presetting the inking zone opening and the ink stripe width is made available to the control system of the printing press which, by a data processing unit, calculates the necessary data with which the inking unit of the printing press is then set. Alternatively, the ink demand can also be determined from the digital image data.

With suitable setting values for the pre-inking, the inking unit of the printing press, before the start of the printing operation, is additionally brought into a state with which the inking or ink management comes close to the setting in the production or continuous printing state, so that the quantity of ink in the inking unit corresponds to the ink quantity for the production or continuous printing. With such a start setting of the inking or ink management, i.e., of the ink presetting and the pre-inking, it is then possible to reach the desired state for production or continuous printing with few adjustments.

These adjustments following ink presetting in order to optimize the inking or ink management are regularly performed at the start of the printing operation of a print job. After a few printings, a so-called proof sheet is analyzed. In this regard, the proof sheet that is used is generally a printed copy after some hundred printings. The adjustments are based on an assessment of the proof sheet with regard to the coloring and the ink density, respectively. The examination can be performed manually by the operating personnel of the printing press, but in-line methods are also known in the prior art, by which ink density measurements can be performed automatically.

The respective ink density and the coloring of the first proof sheet depends, in this regard, directly on the setting values of the ink metering and of the pre-inking. Both settings have similar effects upon the printed image and cannot yet be distinguished by using the first proof sheet, because the effects of settings of the ink metering are determinable only after a relatively long prior run of several hundred printings.

If it is determined, based upon the testing, that the coloring and the ink density, respectively, are not optimally set, the setting of the ink metering is then changed, in general. On the other hand, adapting the values for the pre-inking can be successful only when the ink presetting could previously be set up in a specific accuracy range.

European Patent Application EP 0 741 026 A1, corresponding to U.S. Pat. No. 6,373,964, describes a method with which the settings of the inking unit are to be performed in order to avoid faulty printing. In this regard, by image inspection and subsequent control of the ink metering, the printing machine is controlled during production or continuous running operation in order to achieve optimum printed results.

In this method, current image data is determined in on-line operation and compared with desired image data in order to find faults. If a fault should occur, i.e., if deviations of the actual image data from the desired image data should be found, a check is made based upon different types of faults to determine which fault has caused the deviation. In this regard, a systematic interrogation procedure is carried out, so that it is finally possible to determine whether faulty settings in the ink metering are involved in the determined deviation.

In order to achieve a reliable determination of faults and rectification of faults, respectively, with regard to the production or continuous printing process, it is proposed, in this regard, that the fault analysis be performed before any change in the settings of the ink metering. In this regard, various, predefined criteria are applied in succession systematically in order to determine the type of fault, and the origin of the fault is thus determined. Corrective measures can then be carried out specifically when a deviation is determined.

European Patent Application EP 0 741 031 A2 relates to a method of determining the dynamic characteristics of closed-loop control systems in control-loop forming inking zones of inking units of a printing press.

In order to achieve optimum control results in controlling the inking of printing presses, it is necessary for the dynamic characteristics of the control to be matched to the closed-loop control system. By optimum control results there is meant to be a minimum transient time during desired or nominal value changes and the fastest possible control of faults. In the aforementioned control system, the closed-loop controlled system includes the inking zone of a printing unit of the printing press. The controlled variable is determined by measurement and compared with a reference variable. The control deviation determined from the comparison of the variables is fed to a closed-loop controlled system as actuating variable via a control and an actuating element. The control loop has a measuring device, which registers the actual value and supplies it to a comparison element, in order to determine the control deviation in comparison with the desired or nominal value. Depending upon the determined control deviation, the control actuates an actuating element which acts upon the closed-loop controlled system. In the case at hand, the controlled-loop controlled system is formed by the inking zone of the inking unit, and, consequently, the thickness of the gap of the inking zone is set by a suitable actuating drive, so that a corresponding ink layer thickness is set on the printed copy.

For the necessary adaptation of the control to the dynamic characteristics of the closed-loop controlled system, it is necessary to set the control parameters. In order to determine the control parameters, the controlled system is matched by a suitable model and, for the latter, the optimal control and the corresponding parameters are defined. The controls can have different time responses. In order to identify the closed-loop controlled section, the reaction to a step or jump change in the actuating variable is analyzed. A so-called step or jump response and transfer function, respectively, are then available. For closed-loop controlled systems with a relatively constant response, this can be identified in accordance with the aforedescribed procedure, which is preferably carried out once during the installation of the system. With regard to the closed-loop controlled systems considered here, namely the aforementioned printing unit zones variable in the zone opening, such a constant response is not present, however, because the dynamic characteristics can vary from print job to print job, and even within one print job. Determining the control parameters in advance during the installation is therefore unsatisfactory.

For each print job, the controlled system must be relearned. Before starting the actual print job, the transfer function necessary for control or controller matching therefore has to be determined, but this entails very large quantities of paper wastage. Moreover, in such a case, the dynamic characteristics of the closed-loop controlled system can be determined only at the time of the determination. Changes which arise during the print job remain unconsidered.

Furthermore, it is possible that a plurality of simultaneous or approximately simultaneous adjustments in various printing units and two or more adjustments carried out shortly after one another on a printing unit, respectively, will lead to superimpositions. As a result, these superimpositions can no longer be separated from one another, so that an identification of the dynamic characteristics of the closed-loop controlled system is impossible.

In order largely to avoid wastage occurring during printing and the occurrence of the aforementioned superimposition problems, respectively, the prior art document proposes a method of determining the dynamic characteristics of inking zones of inking units of a printing press. In this regard, jump or step responses occurring during printing in order to carry out a print job and based upon changes in actuating variables have a heretofore known sensitivity matrix applied thereto, for unraveling the superimpositions in order to detect the individual dynamic response of every inking unit and the inking unit, respectively.

Consequently, the sensitivity matrix known to those skilled in the art in the respective case from the ink control is used, in order to draw conclusions about the dynamic response of the closed-loop controlled system from the measured information, namely from the natural step or jump responses. The sensitivity matrix represents a connection between the measured values and the closed-loop controlled systems (actuating variables).

In this method, the determination of the dynamic characteristics is carried out during the print job, i.e., not in a previous process. Naturally occurring changes in actuating variables serve as a basis for obtaining the jump or step responses. This results in the dynamic characteristics having to be determined repeatedly during the entire processing time of a print job, in order to be able to react to any changes in these characteristics which may possibly arise.

In the aforedescribed procedures from the prior art, it has become apparent that the detection of faults is suitable only for optimizing the ink metering in a production or continuous printing operation, i.e., when a setting of the inking or ink management which is adequate for the print job has already been performed. For the detection of setting faults at the start of printing and for the optimization of the printing result by predefining optimized setting values of the pre-inking in order to determine the quantity of ink in the inking unit before the start of printing, respectively, this type of fault detection is inappropriate, because the causes of deviations from the desired or nominal image cannot readily be determined based upon image inspections, particularly when the proof sheet to be tested has already been drawn at an earlier stage after the start of printing a print job, as is necessary for setting the inking or ink management at the start of printing.

A disadvantage of the method described hereinabove is that the settings of the pre-inking and the ink metering must continue to be made manually before the start of printing, so that superimpositions of the effects of these two functions have as a result that deviations from the desired or nominal state cannot be assigned unambiguously to the respective settings of the pre-inking or the ink metering. The conventional setting is thus generally carried out empirically, i.e., a setting value is changed and, following the adjustment, a check is made to see whether an improvement has occurred. In this regard, it is disadvantageous in particular that the duration for reaching a production or continuous printing operation depends upon the required number of setting attempts.

In particular at the start of printing, it has been shown that an assignment of a deviation from the desired or nominal is difficult and, therefore, not inconsiderable quantities of wastage can accumulate when setting up a print job. Furthermore, setting up a print job is time-consuming, and the production or continuous printing state is reached only after a considerable prerunning or advance running time.

SUMMARY OF THE INVENTION

It is accordingly an object of the invention to provide a method of controlling printing presses, which overcomes the hereinafore-mentioned disadvantages of the heretofore-known methods of this general type, which provides heuristic inking or ink management and which ensures the achievement of a production or continuous printing state quickly after a start of printing, after which printed sheets can be printed in a constantly good printing quality with the highest production speed until the end of a print job. More particularly, it is an object of the invention to provide a method with which inking or ink management, i.e., pre-inking and ink presetting for determining the quantity of ink in the inking unit, can be set quickly and optimally before the start of printing, so that wastage can be minimized.

With the foregoing and other objects in view, there is provided, in accordance with the invention, a method of controlling printing presses, which comprises setting inking by determining setting values for at least one of pre-inking and ink metering, encompassing inking zone opening and ink stripe width, and transmitting the determined setting values to controls of the printing press. According to the method, the inking is preset by setting values of earlier print jobs stored in the machine, the printing results are optimized by correcting for each print job, and corrected setting values are stored for subsequent print jobs.

In accordance with another mode, the method invention includes at least one of correcting erroneous settings, and optimizing inking at the start of printing a print job.

In accordance with a further mode, the method invention includes performing the presetting of the inking and of an inking unit therefor by the controls.

In accordance with an added mode, the method invention further includes calculating new setting values for the inking from the respective setting values at the start of the print job and from the corrected setting values after optimization by the controls, by error calculation. The calculated new setting values are stored in order to change the presetting of the inking for a subsequent print job.

In accordance with an additional mode, the method invention further includes correcting under-inking or over-inking of a proof sheet by determining an inking zone adjustment required for eliminating the erroneous inking. Differential values for a change in the setting values of the inking are determined by the inking zone adjustment. The differential values for changing the inking unit setting are stored or the differential values are transmitted to the controls of the printing press.

In accordance with yet another mode, the method invention includes determining an average adjustment of the inking zone opening for optimizing the inking, and calculating an optimized adjustment of the pre-inking from the value for the average adjustment and previously calculated characteristic values for ink stripe width and inking zone opening as a function of the number of printing operations. The optimized adjustment is stored in order to change the inking for a subsequent print job and/or the optimized adjustment is transmitted to the controls of the printing press.

In accordance with a concomitant mode, the method invention further includes calculating at least one new set of characteristic values for at least one of ink stripe width and inking zone opening as a function of the number of printing operations with the newly calculated value for the average adjustment of the inking zone opening. The set of characteristic values is stored for subsequent optimizations.

The method of the invention thus includes presetting the inking or ink management by storing setting values from earlier print jobs on the printing press. In order to optimize the printing results for each print job, the stored setting values are corrected and the corrected setting values are stored for subsequent print jobs.

The inking or ink management, which includes the setting values of the pre-inking and the ink presetting, is advantageously checked during each print job and, if necessary or desired, is corrected. The changes to the inking or ink management, which is carried out with the correction, i.e., the setting values for the pre-inking for determining the quantity of ink in the inking unit before the start of printing, the inking zone opening and the ink strip width, are stored together, analyzed and converted into new values. The new values are then available to the controls of the printing press for presetting the inking unit for the next print job.

Therefore, necessary changes in the setting values of the inking or ink management can be used for subsequent print jobs and thus, little by little, the number of printed copies until the production or continuous printing state can be reduced considerably.

To this end, provision is advantageously made for the presetting of the inking or ink management and of the inking unit therefor to be performed by the controls.

An advantageous development of the method according to the invention is achieved in that new setting values for the inking or ink management are calculated from the respective setting values at the start of the print job and from the corrected setting values following optimization by the control system, by error calculation, and are stored in order to change the presetting of the inking or ink management for the following print job.

It is advantageous thereby that the changes in the inking or ink management are not carried out in absolute terms, with which erroneous correction would possibly be passed on directly to the next print job, but instead, the changes are converted by statistical methods of error calculation and stored in the controls or controller as an approximate value for subsequent print jobs. For the next print job, the ink presetting can then be performed with the determined approximate values.

Furthermore, it is advantageous that possibly once faulty settings will have no marked influence on subsequent print jobs, because the controls or controller of the printing press processes only statistical averages further. A further advantage, in this regard, is that, as the number of print jobs increase, the approximate values are equalized with the optimal values, so that the controls of the printing press "learn" with each print job, whereby the set-up times for the print jobs can be shortened rapidly and it is, accordingly, possible to reach the production or continuous printing state more quickly.

A configuration of the method according to the invention is provided wherein, in order to correct under-inking or over-inking of a proof sheet, an inking zone adjustment is determined which is required to rectify the faulty inking and, by adjustment of the inking zone, the differential values for changing the setting values of the inking or ink management are determined and stored in order to change the inking unit setting and/or transmitted to the controls of the printing press.

In order for the method according to the invention to be able to use adjustments performed in an optimum manner, during the setting up of a print job, provision is made for the differential values of the adjustments to be determined. Together with the differential values of the adjustments from preceding print jobs, averages can then be calculated, which are used as an average adjustment for a new adjustment.

A development of the method is achieved in that, for optimizing the inking or ink management, an average adjustment of the inking zone opening is determined and, from the value for the average adjustment and with previously calculated characteristic values for ink stripe width and inking zone opening, depending upon the number of print jobs, an optimized adjustment of the pre-inking is calculated and stored in order to change the inking or ink management for the subsequent print job and/or is transmitted to the controls of the printing press. In this regard, the average adjustment of the inking zone opening is used instead of individual inking zone values. In order to calculate the average from the previously calculated characteristic values, the values of the setting of the inking zone opening, when the production or continuous printing state is reached, which would be with the values of the average adjustment, are preferably determined and, using the prescribed value of the average inking zone opening when the production or continuous printing state is reached, result in a value for the normalized deviation.

This normalized deviation can then be used as a basis for calculating the relative deviation as a function of the number of printing operations which are required until the production or continuous printing state is reached. To this end, provision is made for a reference value to be determined for the proof sheet being used as a basis, which represents the number of printing operations performed up to the proof sheet. The optimized deviation is then determined by characteristic values which are calculated in advance.

By using the value and values, respectively, of the relative deviation, the value for the change in the pre-inking i.e., the change in the quantity of ink, can then be determined, for example as a number of vibrator roller cycles for the pre-inking. For this purpose, the appropriate values for the adjustment are determined from previously calculated characteristic values.

A development of the invention is provided in that at least one new set of characteristic values for ink stripe width and/or inking zone opening is calculated as a function of the number of printing operations, using the newly calculated value for the average adjustment of the inking zone opening, and is stored for subsequent optimizations.

It is therefore advantageously possible to match the characteristic values to the newly calculated values for the inking or ink management, so that the determination of the optimized adjustment can always be performed with updated characteristic values.

It is advantageous in this case that the inking zone opening can be preset quickly close to the magnitudes required for production or continuous printing. It is therefore possible, by using the information about the first adjustment and the inking zone opening, when reaching the production or continuous printing state, to derive therefrom how the ink input is to be set optimally for the next print job. In this regard, it has proven to be advantageous that both the inking or ink management and the pre-inking i.e., inking zone adjustment, ink stripe width and quantity of ink, can be optimized for the next print job, preferably at least approximately simultaneously. Time-consuming and material-consuming individual optimizations are thus avoided. Furthermore, it is advantageous that the settings of the various influencing variables, the effects of which are similar, are registered and stored after the optimization, and can be used for subsequent print jobs. Consequently, erroneous settings can be detected by the system.

Other features which are considered as characteristic for the invention are set forth in the appended claims.

Although the invention is illustrated and described herein as embodied in a method of controlling printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the accompanying drawing.

DESCRIPTION OF THE PREFERRED EMBODIMENTS

Figure 1:
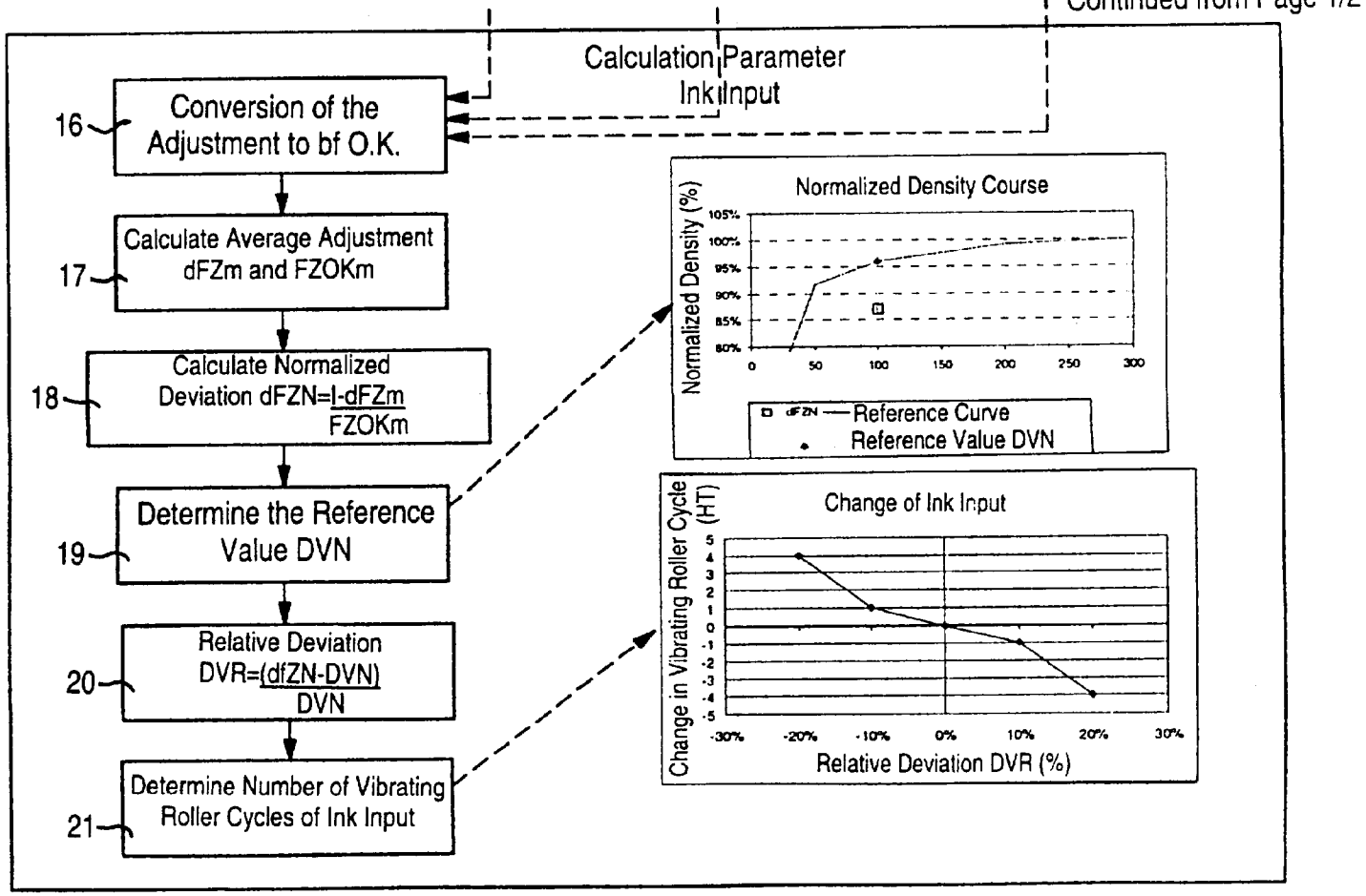
FIG. 1 is a flow chart depicting the method according to the invention.

Referring now in detail to the single figure of the drawing, there are seen details of the method according to the invention which are illustrated in a flow chart formed of two parts and identified as a whole as FIG. 1. The pre-inking and the ink presetting of the ink metering are set with characteristic values for setting up the inking or ink management. These setting values are known from earlier print jobs, or the printing press control system has previously been configured with these setting values.

The setting values of the ink metering include the values of the inking zone opening and of the ink stripe widths. The pre-inking determines the quantity of ink which is introduced into the printing unit before printing, in order to bring the inking unit into a state that is as close as possible to the production or continuous printing state.

This setting up is illustrated in steps 1 to 5 wherein, for achieving a zonal area coverage 1, via stored characteristic values 2, setting values for ink stripe width 3 and for inking zone opening 4 are prescribed. The presetting is completed with a setting of the pre-inking 5.

After this presetting has been completed, the print job is started, the ink density on the printing material resulting as a function of the presetting. After a number of printings, a proof sheet is removed at 6 and tested at 7 and 8 in order to check the settings.

If the ink density determined on the proof sheet corresponds to the intended inking, i.e., the ink density is satisfactory, a change can readily be made over to the production or continuous printing state at 9. The setting values are then stored as OK settings at 10, and a new set of characteristic values 11 is calculated with the appropriate OK inking zone opening and the OK ink stripe width for the ink presetting of the next print job. The calculation of the new characteristic values at 11 is performed based upon the original characteristic values at 2, a check being made as to whether the new characteristic values at 11 lie within a prescribed tolerance 13. If this is not so, no new values are determined for the pre-inking at 14, otherwise new setting values at 15, the OK inking zone opening and the OK ink stripe width, respectively, are calculated for the pre-inking.

If the coloring determined on the proof sheet does not correspond to the desired or nominal coloring, a correction of the ink metering is performed at 8. The correction is made as a function of the number of printing operations already performed up to the proof sheet, and to this end the number of printed copies is determined with respect to the sheet count of the proof sheets at 12.

The adjustment which is made at the proof sheet is analyzed and converted to an adjustment which, after a number of further printing operations, leads to the production or continuous printing state at 16. From this value, an average adjustment is determined at 17. This is performed in accordance with the rules of error calculation. With the value of the average adjustment, a normalized deviation is then calculated and a reference value is determined which is ascertainable from a set of characteristic values of the normalized ink density profile at 18. With this reference value, the value for the relative deviation is calculated at 20, by which, in light of characteristic values, the change of the pre-inking can be determined at 21.

Provision is made for the characteristic values for the change in the pre-inking to be determined so that therefrom directly the number of vibrator roller cycles is determinable and transmitted to the machine control system.

The setting values determined during the correction are then processed further, as described hereinabove, for recalculating the setting characteristic values and for adjusting the ink presetting in 11 to 14.

We claim:

1. A method of controlling a printing press, which comprises:

determining setting values for presetting inking for pre-inking and ink metering encompassing inking zone opening and ink stripe width;

transmitting the setting values to controls of the printing press;

after printing a certain number of sheets, taking out and evaluating a proof sheet taking into account the sheet number;

optimizing printing results by correcting the ink metering until an OK sheet is achieved; and comparing the setting values for the OK sheet with the presettings at the start of the print job;

calculating new parameters for the pre-inking upon an average adjustment of the inking zone opening and storing the new parameters for the adjusting of inking for a subsequent print job.

2. The method according to claim 1, which includes at least one of correcting erroneous settings, and optimizing inking at a start of printing a print job.

3. The method according to claim 1, which comprises performing the presetting of the inking and of an inking unit therefor with the controls.

4. The method according to claim 1, which further comprises:

calculating new setting values for the inking from respective setting values at the start of the print job and from the corrected setting values after optimization by the controls, by error calculation; and storing the calculated new setting values for changing the presetting of the inking for a subsequent print job.

5. The method according to claim 1, which comprises:

determining an average adjustment of the inking zone opening for optimizing the inking;

calculating characteristic values for ink stripe width and inking zone opening as a function of the number of printing operations;

calculating an optimized adjustment of the pre-inking from the value for the average adjustment and the previously calculated characteristic values; and at least one of storing the optimized adjustment for changing the inking for a subsequent print job, and transmitting the optimized adjustment to the controls of the printing press.

6. The method according to claim 5, which further comprises:

calculating at least one new set of characteristic values for at least one of ink stripe width and inking zone opening as a function of the number of printing operations with the newly calculated value for the average adjustment of the inking zone opening; and storing the set of characteristic values for subsequent optimizations.

7. The method according to claim 1, which further comprises:

correcting under-inking or over-inking of the proof sheet by determining an inking zone adjustment required for eliminating erroneous inking;

determining differential values for a change in the setting values of the inking by the inking zone adjustment; and at least one of storing the differential values for changing the inking unit setting and transmitting the differential values to the controls of the printing press.

* * * * *